United States Patent [19]

Kokubo et al.

[11] Patent Number: 4,726,523

[45] Date of Patent: Feb. 23, 1988

[54] ULTRASONIC INJECTION NOZZLE

[75] Inventors: Kakuro Kokubo, Atsugi; Masami Endo, Kawasaki; Hideo Hirabayashi, Yachiyo; Yoshinobu Nakamura, Urawa; Daijiro Hosogai, Kawajima, all of Japan

[73] Assignee: Toa Nenryo Kogyo Kabushiki Kaisha, Tokyo, Japan

[21] Appl. No.: 806,166

[22] Filed: Dec. 6, 1985

[30] Foreign Application Priority Data

Dec. 11, 1984 [JP] Japan ..... 59-260062
Dec. 11, 1984 [JP] Japan ..... 59-260063

[51] Int. Cl.[4] ..... B05B 3/00

[52] U.S. Cl. ..... 239/102.2; 239/498; 239/500; 239/585

[58] Field of Search ..... 239/102, 498, 500, 501, 239/585, 102.2

[56] References Cited

U.S. PATENT DOCUMENTS

| | | | |
|---|---|---|---|
| 578,461 | 3/1897 | Mertz | 239/498 |
| 1,659,538 | 2/1928 | Angrove . | |
| 1,730,664 | 10/1929 | Kruse | 239/590.5 |
| 1,758,119 | 5/1930 | LeMoon | 239/460 |
| 2,596,341 | 5/1952 | McCreery et al. | 239/590.5 |
| 2,712,962 | 7/1955 | Goddard | 239/500 X |
| 3,110,444 | 11/1963 | Eakins | 239/500 |
| 3,317,139 | 5/1967 | Freeland | 239/102 |
| 3,373,752 | 3/1968 | Inoue | 239/4 |
| 3,749,318 | 7/1973 | Cottell | 239/102 |
| 3,756,575 | 9/1973 | Cottell | 261/1 |
| 4,197,997 | 4/1980 | Wu et al. | 239/102 |
| 4,350,302 | 9/1982 | Gruber et al. | 239/500 |
| 4,372,491 | 2/1983 | Fishgal | 239/102 |
| 4,403,741 | 9/1983 | Moriya et al. | 239/585 |
| 4,408,722 | 10/1983 | Freland | 239/533.12 |
| 4,474,326 | 10/1984 | Takahashi | 239/102 |
| 4,496,101 | 1/1985 | Northman | 239/102 |
| 4,501,406 | 2/1985 | Walther et al. | 251/30 |
| 4,541,564 | 9/1985 | Berger et al. | 239/102 |

FOREIGN PATENT DOCUMENTS

| | | | |
|---|---|---|---|
| 159189 | 10/1985 | European Pat. Off. | 239/124 |
| 861344 | 7/1949 | Fed. Rep. of Germany . | |
| 2239408 | 2/1974 | Fed. Rep. of Germany | 239/102 |
| 786492 | 9/1935 | France | 239/498 |
| 197801 | 1/1978 | U.S.S.R. | 239/498 |

*Primary Examiner*—Andres Kashnikow
*Assistant Examiner*—Michael J. Forman
*Attorney, Agent, or Firm*—Seidel, Gonda, Goldhammer & Abbott

[57] ABSTRACT

An ultrasonic injection nozzle includes an ultrasonic generator, an elongated vibrating element, a liquid feeder and a solenoid valve. The vibrating element has a first and second end. The generator is connected to the first end. A multi-stepped edge portion is connected to the second end. Each step of the edged portion defines an edge. The liquid feeder is located adjacent the second end. The solenoid valve is in communication with the liquid feeder.

4 Claims, 4 Drawing Figures

ULTRASONIC INJECTION NOZZLE

TECHNICAL FIELD

This invention relates generally to ultrasonic injection nozzles, and particularly to electronically controlled gasoline injection valves or electronically controlled diesel injection valves, (2) gas turbine fuel nozzles, (3) burners for use on industrial, commercial and domestic boilers, heating furnaces and stoves, (4) industrial liquid atomizers such as drying atomizers for drying liquid materials such as foods, medicines, agricultural chemicals, fertilizers and the like, spray heads for controlling temperature and humidity, atomizers for calcining powders (pelletizing ceramics), spray coaters and reaction promoting devices, and (5) liquid atomizers for uses other than industrial, such as spreaders for agricultural chemicals and antiseptic solution.

BACKGROUND ART

Pressure atomizing burners or liquid spray heads have been heretofore used to atomize or spray liquid in the various fields of art as mentioned above. The term "liquid" herein used is intended to mean not only liquid but also various liquid materials such as solution, suspension and the like. Injection nozzles used with such spray burners or liquid atomizers atomizing the liquid on the shearing action between the liquid as discharged through the nozzles and the ambient air (atmospheric air). Thus, increases pressure under which to supply liquid was required to achieve atomization of the liquid, resulting in requiring complicated and large-sized liquid supplying means such as pumps. Furthermore, regulation of the flow rate of injection was effected either by varying the pressure under which to deliver supply liquid or by varying the area of the nozzle discharge opening. However, the former method provided poor atomization at a low flow rate (low pressure), as a remedy for which air or steam was additionally used on medium or large-sized boilers to aid in atomization of liquid, requiring more and more complicated and enlarged apparatus. On the other hand, the latter method required an extremely intricate construction of nozzle which was very troublesome to control and maintain.

In order to overcome the drawbacks to such conventional injection nozzles, attempts have been made to impart ultrasonic waves to liquid material while it is injected out through the jet of the injection nozzle under pressure.

However, the conventional ultrasonic liquid injecting nozzle had so small capacity for spraying that it was unsuitable for use as such injection nozzle as described above which required a large amount of atomized liquid.

As a result of extensive researches and experiments conducted on the ultrasonic liquid atomizing mechanism and the configuration of the ultrasonic vibrating element in an attempt to accomplish atomization of a large amount of liquid, the present inventors have discovered that a large quantity of liquid may be atomized by providing an ultrasonic vibrating element formed at its end with an edged portion along which liquid may be delivered in a film form, and have proposed an ultrasonic injection method and injection nozzle based on said concept as disclosed in Japanese Patent Application No. 59-77572.

The present invention relates to improvements on the ultrasonic injection nozzle of the type according to the invention of the aforesaid earlier patent application.

SUMMARY OF THE INVENTION

It is an object of this invention to provide an ultrasonic injection nozzle which is capable of delivering liquid either intermittently or continuously.

It is another object of the invention to provide an ultrasonic injection nozzle which is capable of feeding a large quantity of liquid and spraying or injecting it and which facilitates automatic control of the operation.

It is still another object of the invention to provide an ultrasonic injection nozzle which is simple in construction and in which the pressure required under which to supply liquid is noticeably low as compared to the conventional injection nozzle so that the size, weight and initial cost of the associated liquid supplying facility may be reduced.

It is yet another object of the invention to provide an ultrasonic injection nozzle which is capable of accomplishing consistent atomization with virtually no change in the conditions of atomization such as flow rate and particle size depending upon the properties, particularly the viscosity of the supply liquid.

It is yet another object of the invention to provide an ultrasonic injection nozzle which provides for stable and substantially consistent atomization even at a low flow rate, and hence permits a very high turndown ratio.

The aforesaid objects may be accomplished by the an ultrasonic injection nozzle according to the present invention.

Briefly, the invention consists in an ultrasonic injection nozzle comprising an ultrasonic vibration generating means, an elongated vibrating element connected at one end to said ultrasonic vibration generating means and having an edged portion at the other end, and a liquid feeding means provided adjacent that end of said vibrating element having said edged portion for feeding liquid to said edged portion continuously or intermittently.

According to one embodiment of the invention, said liquid feeding means including one or more liquid supply passages having its or their outlets opening adjacent the upper end of said edged portion. More preferably, a solenoid valve is disposed in a conduit leading to said liquid feeding means to control the flow of liquid to the liquid feeding means.

According to another embodiment of the invention, said liquid feeding means comprises a hollow needle valve slidably mounted on said vibrating element adjacent that end of the element having said edged portion, a liquid supply passage for feeding liquid to said edged portion, spring means for normally urging said hollow needle valve toward said liquid supply passage to close the passage, and solenoid means operable on said needle valve to move the needle valve against the biasing force of said spring means in a sense to open the liquid supply passage.

Specific embodiments of the present invention will now be described by way of example and not by way of limitation with reference to the accompanying drawings.

DESCRIPTION OF THE PREFERRED EMBODIMENTS

While the present invention is suitably applicable to the various applications as indicated hereinbefore, it will be described here with reference to a fuel nozzle for a gas turbine.

Figure 1:
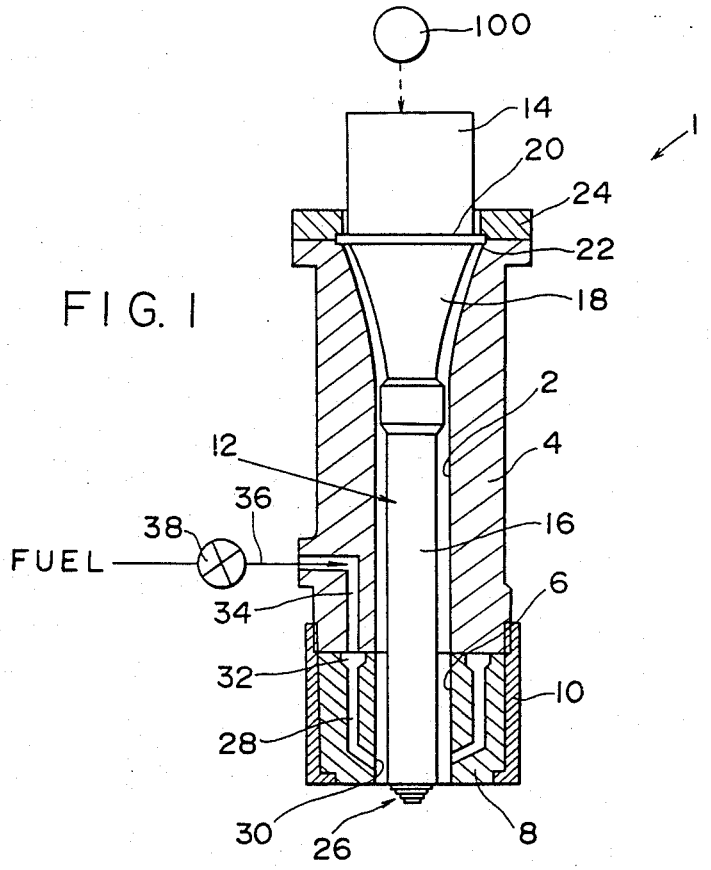
FIG. 1 is a cross-sectional view of one embodiment of the ultrasonic injection nozzle according to this invention.

Referring first to FIG. 1, an injection nozzle according to this invention, which is a gas turbine fuel nozzle 1 in the illustrated embodiment, includes a generally cylindrical elongated valve housing 4 having a central bore 2 extending through the center thereof. A liquid or fuel feeding means 8 having a through bore 6 in coaxial alignment with the central bore 2 of the valve housing 8 is connected integrally to the lower end of the valve housing by means of a retainer 10 in a conventional manner.

A vibrating element 12 is mounted extending through the central bore 2 of the valve housing 4 and the through bore 6 of the fuel feeding means 8. The vibrating element 12 comprises an upper body portion 14, an elongated cylindrical vibrator shank 16 having a diameter smaller than that of the body portion 14, and a transition portion 18 connecting the body portion 14 and the shank 16. the body portion 14 has an enlarged diameter collar 20 therearound which is clamped to the valve housing 4 by a shoulder 22 formed in the upper end of the valve housing and an annular vibrator retainer 30 fastened to the upper end face of the valve housing by bolts (not shown).

The shank 16 of the vibrating element 12 extends downwardly or outwardly beyond the valve housing 4 and liquid feeding means 8. The forward end of the vibrating element 12, that is, the forward end of the shank portion 16 is formed with an edged portion 26.

The edged portion 26 of the vibrating element 12 may be in the form of an annular staircase including five concentric steps each defining an edge therearound, the edges of the steps having progressively reduced diameters, as shown in FIG. 1. However, the edged portion may comprise two, three or four or any other number of steps. Further, the edges may have progressively increasing diameters; or progressively reduced and then increasing diameters, or equal diameters. Of importance is it that the forward end of the vibrating element is formed with edges.

Figure 2:
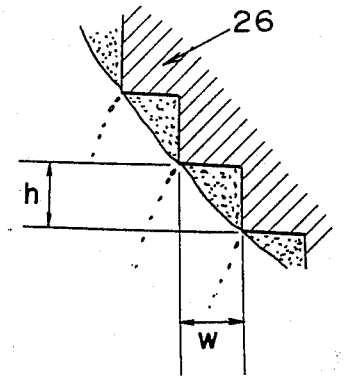
FIG. 2 is an enlarged fractionary view of the edged portion of the vibrating element incorporates in the nozzle shown in FIG. 1.

Further, as shown in FIG. 2, the geometry such as the width (W) and height (h) of each step is such that the edge of the step may act to render the liquid fuel filmy and to dam the liquid flow.

The fuel feeding means 8 includes one or more circumferentially spaced supply passages 28 for feeding the edged portion 26 of the vibrating element 12 with fuel. Fuel outlets 30 of the supply passages 28 open into the bore 6 adjacent the upper end of the edged portion 26 while inlets of the supply passages 28 are connected with each other and in communication with a fuel inlet passage 34 formed through the valve housing 4. The inlet passage 34 is fed with liquid fuel through an external line 36 leading from a source of fuel (not shown). A supply valve 38 is disposed in the line 36 to control the flow and flow rate of fuel. The supply valve 38 may be a solenoid valve and fuel from the source is delivered under a constant pressure. The solenoid valve 38 may be supplied with electric current to be actuated intermittently whereby the injection nozzle 1 may be employed as an electronically controlled gasoline injection valve or an electronically controlled diesel injection valve.

In the arrangement described above, the vibrating element 12 is continuously vibrated by the ultrasonic vibration generating means 100 operatively connected to the body portion 14, so that liquid fuel is atomized and discharged out as it is delivered to the edged portion 26 through the line 36, valve 36, inlet passage 34 and supply passages 28.

An example of various parameters and dimensions applicable to the ultrasonic injection nozzle as described above is as follows:

| | |
|---|---|
| Output of ultrasonic vibration | |
| generating means | 10 watts |
| Amplitude of vibration of vibrating element | 30 um |
| Frequency of vibration | 38 KHz |
| Geometry of edged portion of vibrating element | |
| First step | 7 mm in diameter |
| Second step | 6 mm in diameter |
| Third step | 5 mm in diameter |
| Fourth step | 4 mm in diameter |
| Fifth step | 3 mm in diameter |
| Height (h) of each step | 3 mm in diameter |
| Fuel type of oil | Kerosene |
| Flow rate | 10 $cm^3$/sec |
| Injection pressure | 5 $Kg/cm^2$ |
| Temperature | Normal temperature |
| Material for vibrating element | Titanium (or iron) |

Figure 3:
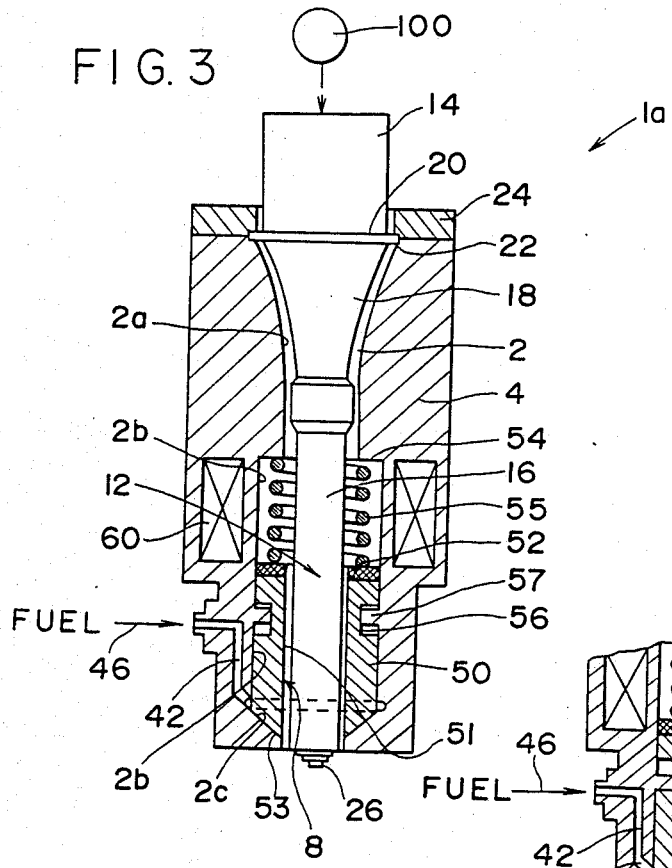
FIG. 3 is a cross-sectional view showing another embodiment of the ultrasonic injection nozzle according to this invention in its inoperative position.
Figure 4:
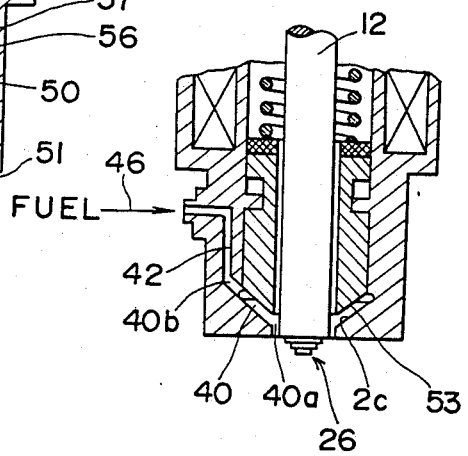
FIG. 4 is a cross-sectional view showing the ultrasonic injection nozzle of FIG. 3 in its operative position.

FIGS. 3 and 4 illustrate another embodiment of the injection nozzle according to this invention. The invention will be described with reference to a gas turbine fuel nozzle in this embodiment as well.

Referring to FIG. 3, the injection nozzle according to this invention, which is a gas turbine fuel nozzle 1*a* in the illustrated embodiment, includes a generally cylindrical elongated valve housing 4 having a central bore 2 extending centrally therethrough.

The central bore 2 comprises an upper bore portion 2*a*, an enlarged diameter bore portion 2*b* connecting with the upper bore portion, and a tapered bore portion 2*c* connecting with the enlarged bore portion.

Slidably mounted in the enlarged bore portion 2*b* is a generally cylindrical hollow needle valve 50 having a through bore 51 in coaxial alignment with the central bore 2 of the valve housing 4. Connected integrally with the upper end of the hollow needle valve 50 is a core 52, the purpose of which will be explained hereinafter. The lower end of the needle valve is formed with a sloped surface 53 complementary to the tapered bore portion 2*c* of the central bore 2 and cooperative with the tapered bore portion to define a liquid fuel feeding means or liquid supply passage 40 as shown in FIG. 4. The needle valve 50 is normally biased downwardly by spring means 55 disposed between the core 52 and an annular shoulder 54 defined between the upper bore portion 2a and the enlarged bore portion 2b so that the sloped surface 53 is urged into sealing contact with the wall of the tapered bore portion 2c to close the supply passage 40 as shown in FIG. 3.

A vibrating element 12 is mounted extending through the central bore 2 of the valve housing 4 and the through bore 51 of the needle valve 50. The vibrating element 12, as is described with reference to FIG. 1, comprises an upper body portion 14, an elongated cylindrical vibrator shank 16 having a diameter smaller than that of the body portion 14, and a transition portion 18 connecting the body portion 14 and shank 16. The body portion 14 has an elongated diameter collar 22 thereabound which is clamped to the valve housing 4 by means of a shoulder 22 formed on the upper end of the valve housing 4 and an annular vibrator retainer 30 fastened to the upper end face of the valve housing 4 by bolts (not shown).

The shank 16 of the vibrating element 12 extends downwardly or outwardly beyond the tapered bore portion 2c and hence the liquid supply passage 40. The forward end of the vibrating element 12, that is, the forward end of the shank portion 16 is formed with an edged portion 26.

The edged portion 26 is shown here as an annular staircase including four concentric steps having progressively reduced diameters, although it may take various configurations as indicated hereinbefore.

Mounted in the valve housing 4 adjacent said core 52 is solenoid means 60 which may be a conventional electromagnetic coil which is operable, when energized, to lift the core 52 and hence the hollow needle valve 50 upward against the force of the spring means 55. The upward movement of the needle valve 50 may be limited by an annular stop member 57 projecting inwardly from the wall of the enlarged bore portion 2b into an annular recess formed around the outer periphery of the needle valve 50.

As the needle valve 50 is moved upward by the action of the solenoid means 60, the tapered bore portion 2c of the central bore 2 cooperates with the sloped surface 53 of the needle valve to define or open the liquid fuel supply passage 40. The outlet 40a of the supply passage 40 opens into the through bore 51 adjacent the upper end of the edged portion while the inlet end 40b of the supply passage 40 is in communication with a fuel inlet passage 42 which is in turn connected with an external line 46 leading from a source of liquid fuel (not shown).

As is understood from the foregoing, the flow of liquid fuel may be controlled by turning on and off the electric power to the solenoid means 60, and the flow rate of fuel may also be regulated by controlling the amount of electric current supplied to the solenoid means. Further, it is to be appreciated that the present injection nozzle may be employed either as an electronically controlled gasoline injection valve or as an electronically controlled diesel injection valve by energizing the solenoid means intermittently while the supply fuel from the source is maintained at a constant pressure.

With the construction described above, the vibrating element 12 is continuously vibrated by the ultrasonic vibration generating means 100 operatively connected to the body portion 14, so that upon energization of the solenoid means 60 the liquid fuel is atomized and discharged out as it is delivered to the edged portion 26 through the line 46, inlet passage 42, and supply passage 40.

An example of various parameters and dimensions applicable to the ultrasonic injection nozzle as described above is as follows:

| | |
|---|---|
| Output of ultrasonic vibration | |
| generating means | 10 watts |
| Amplitude of vibration of vibrating element | 30 um |
| Frequency of vibration | 38 KHz |
| Geometry of edged portion of vibrating element | |
| First step | 7 mm in diameter |
| Second step | 6 mm in diameter |
| Third step | 5 mm in diameter |
| Fourth step | 4 mm in diameter |
| Height (h) of each step | 1.5 mm in diameter |
| Fuel type of oil | Kerosene |
| Flow rate | 10 $cm^3$/sec |
| Injection pressure | 5 $Kg/cm^2$ |
| Temperature | Normal temperature |
| Material for vibrating element | Titanium (or iron) |

In contrast to the conventional injection nozzle which required a fuel supply pressure of 30 to 100 $Kg/cm^2$, the injection nozzle according to this invention requires a relatively low pressure of zero to several tens of $Kg/cm^2$, providing for reducing the size, weight and initial cost of the fuel feeding facility. Furthermore, the use of the present injection nozzle makes it possible to spray or atomize a large quantity of liquid continuously or intermittently.

In addition, according to this invention, the flow and flow rate of supply liquid may be controlled by electromagnetic means so that control of the injection may be easily effected and automated.

Moreover, the present injection nozzle is capable of consistent automization of liquid even at a low flow rate irrespective of the properties of the liquid, and permits a very large turndown ratio.

We claim:

1. An ultrasonic injection nozzle comprising:

an ultrasonic vibration generating means;

an elongated vibrating element having a first and second end, said ultrasonic generating means being connected to said first end;

a multi-stepped edged portion being connected to said second end of said element, each step of said edged portion defining an edge;

a liquid feeding means for feeding liquid to said edged portion and being adjacent said second end of said element; and a solenoid valve in communication with said liquid feeding means.

2. An ultrasonic injection nozzle according to claim 1 wherein said liquid feeding means includes at least one liquid supply passage having a liquid outlet opening adjacent said edged portion and for feeding liquid to the edged portion.

3. An ultrasonic injection nozzle according to claim 1 or 2 wherein said solenoid valve is disposed in a line leading to said liquid feeding means to control the flow of liquid to said feeding means.

4. An ultrasonic injection nozzle according to claim 1 wherein said solenoid valve includes a hollow needle valve slidably mounted on said vibrating element adjacent said second end of the element, said liquid feeding means includes a liquid supply passage for feeding liquid to said edged portion, spring means for normally urging said needle valve toward said liquid supply passage to close the passage, and electromagnetic means operable on said needle valve to move the valve against the force of said spring in a sense to open the liquid supply passage.

* * * * *